US011377958B2

(12) United States Patent
Lemarchand et al.

(10) Patent No.: US 11,377,958 B2
(45) Date of Patent: Jul. 5, 2022

(54) TURBOMACHINE FAN FLOW-STRAIGHTENER VANE, TURBOMACHINE ASSEMBLY COMPRISING SUCH A VANE AND TURBOMACHINE EQUIPPED WITH SAID VANE OR SAID ASSEMBLY

(71) Applicant: SAFRAN AIRCRAFT ENGINES, Paris (FR)

(72) Inventors: Kevin Morgane Lemarchand, Moissy-Cramayel (FR); Norman Bruno André Jodet, Moissy-Cramayel (FR); Guillaume Martin, Moissy-Cramayel (FR); Laurent Soulat, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 11 days.

(21) Appl. No.: 16/642,150

(22) PCT Filed: Aug. 28, 2018

(86) PCT No.: PCT/FR2018/052114
§ 371 (c)(1),
(2) Date: Feb. 26, 2020

(87) PCT Pub. No.: WO2019/043330
PCT Pub. Date: Mar. 7, 2019

(65) Prior Publication Data

US 2020/0355085 A1 Nov. 12, 2020

(30) Foreign Application Priority Data

Aug. 28, 2017 (FR) ..... 1757896

(51) Int. Cl.
*F01D 5/14* (2006.01)
*F01D 9/04* (2006.01)

(52) U.S. Cl.
CPC ..... *F01D 5/141* (2013.01); *F01D 9/041* (2013.01); *F05D 2220/323* (2013.01); *F05D 2240/125* (2013.01)

(58) Field of Classification Search
CPC .... F01D 5/141; F01D 9/041; F05D 2220/323; F05D 2240/125
See application file for complete search history.

(56) References Cited

U.S. PATENT DOCUMENTS 4,741,667 A * 5/1988 Price ..... F01D 5/141 415/115
6,036,438 A * 3/2000 Imai ..... F01D 5/142 415/192

(Continued)

FOREIGN PATENT DOCUMENTS

EP 1333181 A1 8/2003
EP 1921007 A2 5/2008
EP 2628919 B1 * 11/2019 ..... F02C 7/04

OTHER PUBLICATIONS

Written Opinion of the International Searching Authority dated Nov. 15, 2018, issued in corresponding International Application No. PCT/FR2018/052114, filed Aug. 28, 2018, 5 pages.

(Continued)

*Primary Examiner* — Michael Lebentritt
*Assistant Examiner* — Brian Christopher Delrue
(74) *Attorney, Agent, or Firm* — Christensen O'Connor Johnson Kindness PLLC

(57) ABSTRACT

A flow-straightener vane of a bypass turbomachine includes a plurality of vane sections stacked radially with respect to a longitudinal axis (X) along a stacking line (L) between a root end and a tip end. Each vane section has a pressure-face (Continued)

surface and a suction-face surface extending axially between an upstream leading edge and a downstream trailing edge. Between the leading and trailing edges of each vane section there is formed a profile chord (CA) the length of which is substantially constant between the tip end and the root end, and the stacking line (L) exhibits a curvature in a plane passing more or less through the axis (X) and through the stacking line (L), situated in the vicinity of the tip end and oriented from downstream towards upstream.

11 Claims, 3 Drawing Sheets

(56) References Cited

U.S. PATENT DOCUMENTS

| | | | | |
|---|---|---|---|---|
| 6,079,948 | A * | 6/2000 | Sasaki | F04D 29/324 416/237 |
| 6,195,983 | B1 * | 3/2001 | Wadia | F04D 29/544 60/226.1 |
| 6,554,564 | B1 * | 4/2003 | Lord | F02K 3/06 415/119 |
| 8,167,548 | B2 * | 5/2012 | Greim | F01D 9/041 415/193 |
| 8,333,559 | B2 * | 12/2012 | Bushnell | F04D 29/544 415/211.2 |
| 9,441,502 | B2 * | 9/2016 | Gbadebo | F01D 25/162 |
| 10,060,263 | B2 * | 8/2018 | Van Ness | F01D 5/142 |
| 10,107,191 | B2 * | 10/2018 | Gilson | F04D 29/664 |
| 10,526,894 | B1 * | 1/2020 | Rose | F04D 29/544 |
| 10,677,264 | B2 * | 6/2020 | Moniz | F02K 3/06 |
| 2016/0222824 | A1 * | 8/2016 | Gersbach | F01D 9/041 |

OTHER PUBLICATIONS

International Search Report dated Nov. 15, 2018, issued in corresponding International Application No. PCT/FR2018/052114, filed Aug. 28, 2018, 7 pages.

* cited by examiner

TURBOMACHINE FAN FLOW-STRAIGHTENER VANE, TURBOMACHINE ASSEMBLY COMPRISING SUCH A VANE AND TURBOMACHINE EQUIPPED WITH SAID VANE OR SAID ASSEMBLY

TECHNICAL FIELD

The present invention relates to the field of turbomachines. It relates to a turbomachine vane and in particular a fan flow-straightener vane. The invention also concerns an assembly comprising a nacelle and a fan casing which is fixed to the nacelle and which is equipped with at least one flow-straightener vane and a turbomachine equipped with such a vane or such an assembly with a flow-straightener vane.

BACKGROUND

The natural evolution of multi-flow turbojet engines with a fan, particularly upstream, is to increase the propulsive efficiency by reducing the specific thrust, obtained by reducing the fan compression ratio, which results in an increase in the bypass ratio (BPR), which is the ratio of the mass flow of air through a vein or veins surrounding the gas generator to the mass flow of air through the gas generator, calculated at the maximum thrust when the engine is stationary in an international standard atmosphere at sea level.

The increase in the bypass ratio affects the diameter of the turbomachine, which is constrained by the minimum ground clearance required due to the integration of the turbomachine most often under the wing of an aircraft. The increase in the bypass ratio takes place primarily on the diameter of the fan. The fan is enclosed by a fan casing which surrounds the fan vanes and is connected to the gas generator by stator vanes known as flow-straighteners or "Outlet Guide Vanes" (abbreviated to OGV). These flow-straightener vanes are arranged radially from the gas generator casing, downstream of the fan vanes, and serve to rectify the flow generated by the latter. These vanes must be arranged at a predetermined minimum axial distance from the fan vanes so as to limit the acoustic interactions responsible for significant noise. The predetermined axial distance between the vanes determines the length of the fan casing. In addition, the weight of the fan casing and in particular its length affects the drag of the turbomachine.

A turbomachine flow-straightener vane arranged downstream of the fan vanes is known from U.S. Pat. No. 6,554,564. This flow-straightener vane has a leading edge with a sweep angle pointing upstream (along the longitudinal axis of the turbomachine) or a trailing edge with a sweep angle pointing downstream (along the longitudinal axis of the turbomachine) so that the chord of these flow-straightener vanes varies from the root end to the tip end. This influences the axial length of the vane and the mass of the vane. These flow-straightener vanes may also comprise a portion of their body with the leading edge and trailing edge having a sweep angle pointing in the same direction, either upstream or downstream. However, for these latter examples of flow-straightener vanes, the sweep angle, formed between two segments of the leading edge or two segments of the trailing edge, forms an obtuse angle or an acute angle. In other words, the sweep angles of the leading and trailing edges form an abrupt change of direction. There is therefore no curvature between two segments of the leading or trailing edge. An example of a flow-straightener vane shown in FIG. 8*c* of this document shows a lower vane portion with a pitch angle A that is completely opposite to that of the upper vane portion. The disadvantage of these abrupt changes in direction is that they increase the vortex phenomena which also cause noise.

The present invention has in particular the objective of limiting the drag of the turbomachine nacelle and of limiting the mass of the propulsion assembly while acting on acoustic phenomena occurring in the vicinity of a flow-straightener vane.

SUMMARY

This is achieved in accordance with the invention by means of a flow-straightener vane of a bypass turbomachine with a longitudinal axis, the vane comprising a plurality of vane sections stacked radially with respect to the longitudinal axis along a stacking line between a root end and a tip end, each vane section comprising an pressure-face surface and a suction-face surface extending axially between an upstream leading edge and a downstream trailing edge and being tangentially opposed, between the leading and trailing edges of each vane section being formed a profile chord the length of which is substantially constant between the tip end and the root end, and the stacking line having a curvature in a plane passing substantially through the longitudinal axis and through the stacking line, located in the vicinity of the tip end and oriented from downstream to upstream.

This solution thus achieves the above-mentioned objective. In particular, the shape of the flow-straightener vane with this curvature makes it possible to shorten the length of the nacelle surrounding the fan casing intended to carry this stator vane, thereby advantageously reducing the drag. It also reduces the noise generated towards the end of the vane tip when the vane tip is mounted in the nacelle. In particular, the sound intensity increases with the proximity between the fan vanes and the flow-straightener vanes. The zones located around 75% of the vane height are particularly affected by these interactions because of the speeds observed and the aerodynamic load involved. The profile of the flow-straightener vane thus makes it possible to maintain the required minimum axial distance to the top of the flow-straightener vanes.

According to one characteristic, the curvature of the stacking line is continuous and progressive. Such a configuration reduces the formation of vortices, which also generate noise. Indeed, a sudden change would significantly affect the vortices that can form in the upper part of the vane and which are a source of noise.

According to a characteristic of the invention, the curvature is between 50% and 95% of the height of the vane between the root end and the tip end. This configuration allows to act at the location where the acoustic and velocity interactions are highest and where the aerodynamic load is involved.

According to a characteristic of the invention, the shape of the vane, between 50% and 95% of the height of the vane, is determined by the following relationship: $0.1<(L2/L1)_{50\%\ H<H<95\%\ H}<0.5$, L2 corresponding to the minimum distance between the leading edge of the vane and a line passing through the root end and the tip end of the vane, L1 corresponding to the length between this same line and the trailing edge of the flow-straightener vane and H being the height of the vane. This configuration makes it possible, on the one hand, to limit the maximum angle at the root end of the vane and, on the other hand, to limit the structural stresses. In other words, the curvature of the flow-straightener vane is defined between 50% and 95% of its height.

According to another characteristic, the vane has a first root portion whose stacking line extends along a straight line and a second tip portion whose stacking line comprises the curvature. This configuration thus only changes the upper part of the flow-straightener vane.

As a further characteristic, the stacking line extending along a straight line is inclined with respect to the longitudinal axis.

According to another characteristic, the leading edge has a concave portion and the trailing edge has a convex portion at the curvature. Thus, the directions of the leading and trailing edges of the vane are substantially parallel to the direction of the stacking line.

The invention also relates to an assembly comprising a bypass turbomachine nacelle extending along a longitudinal axis and a fan casing secured to the nacelle, the fan casing surrounding a fan and delimiting downstream of the fan an annular vein in which an air flow circulates, the fan casing comprising an annular row of flow-straightener vanes having any of the above-mentioned characteristics arranged downstream of the fan vanes transversely in the annular vein. Such a characteristic reduces the length of the nacelle and reduces the acoustic criterion in the upper part of the nacelle. In particular, for a given fan diameter, an acoustic gain of approximately 2 EPNdB ("Effective Perceived Noise" or "Effective Perceived Noise Level in Decibels") is observed.

According to a characteristic of the invention, the nacelle has a length substantially along the longitudinal axis between 3000 and 3800 mm.

According to another characteristic, the nacelle has a length substantially along the longitudinal axis and the fan has a diameter substantially along the radial axis, the ratio of the length of the nacelle to the diameter of the fan being between 1 and 3. In particular, the diameter of the fan is measured at a leading edge at its fan vane tip.

According to a characteristic, the relative axial distance between a fan vane and a flow-straightener vane is determined by the following condition: (d/C) where d is the distance between a trailing edge of the fan and the leading edge of the flow-straightener vane, and C is the length of the axial chord of the fan vane, wherein the curvature of the stacking line verifies the following relationship: $(d/C)_{50\% H<H<95\% H}>(d/C)_{100\% H}$, where H is the height of the flow-straightener vane between the tip end and the root end. $(d/C)_{50\% H<H<95\% H}$ is the distance between the trailing edge of the fan and the leading edge of the flow-straightener vane divided by the length of the axial chord of the fan vane between 50% and 95% of the height of the flow-straightener vane, and $(d/C)_{100\% H}$ is the distance between the trailing edge of the fan and the leading edge of the flow-straightener vane divided by the length of the axial chord of the fan vane at the tip of the flow-straightener vane. In particular (d/C) 100% H corresponds to the vane height at the contact between the flow-straightener vane and the fan casing.

The invention furthermore concerns an assembly comprising a nacelle of a bypass turbomachine extending along a longitudinal axis and a fan casing secured to the nacelle, the fan casing surrounding a fan and delimiting, downstream of the fan, an annular vein in which an air flow circulates, the nacelle comprising an annular row of flow-straightener vanes having any of the above characteristics arranged downstream of the fan vanes transversely in the annular vein and having a downstream end of the tip end located downstream of a downstream end of the fan casing. Such a characteristic reduces the length of the nacelle and reduces the acoustic criterion in the upper part of the nacelle. In particular, for the same given fan diameter, a sound gain of approximately 2 EPNdB ("Effective Perceived Noise" or "Effective Perceived Noise Level in Decibels") is observed.

The invention also relates to a turbomachine comprising at least one flow-straightener vane having at least one of the above-mentioned characteristics.

DESCRIPTION OF THE DRAWINGS

The invention shall be better understood, and other purposes, details, characteristics and advantages of the invention shall appear more clearly on reading the following detailed explanatory description of the embodiments of the invention given as purely illustrative and non-limitative examples, with reference to the attached schematic drawings in which.

DETAILED DESCRIPTION

Figure 1:
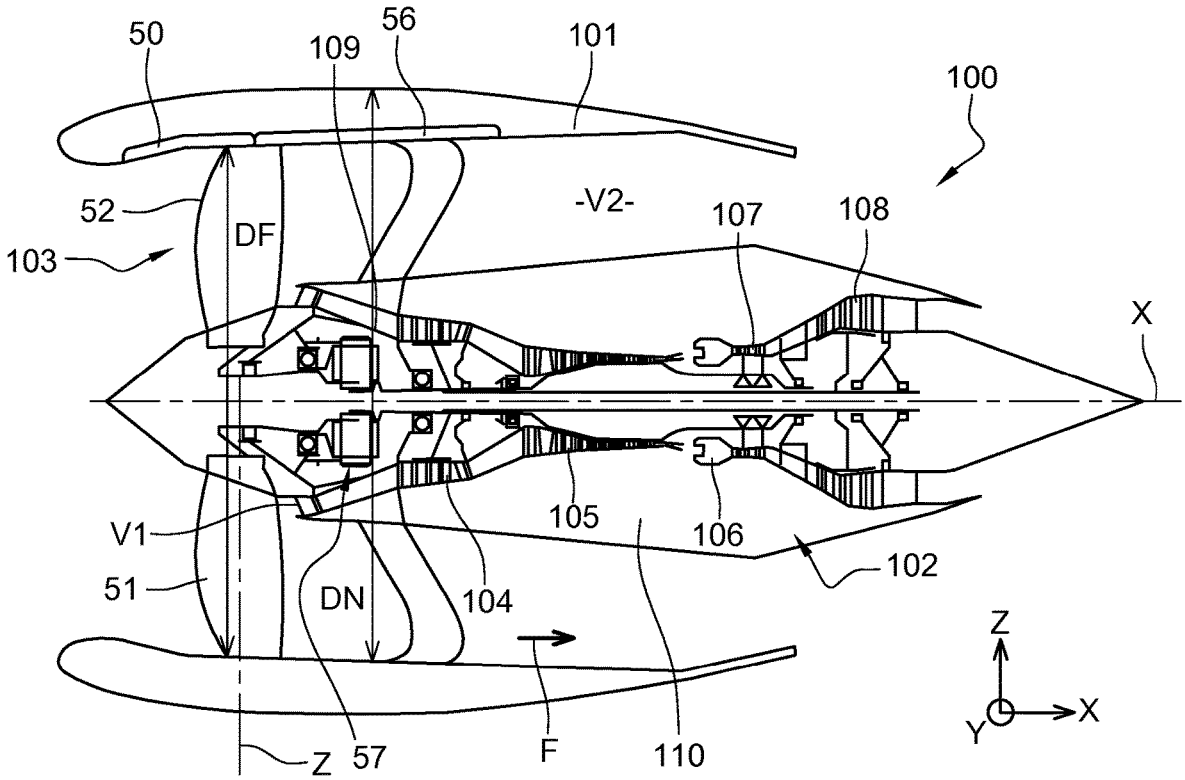
FIG. 1 schematically represents a turbomachine with a fan upstream of a gas generator and to which the invention applies.

FIG. 1 illustrates an aircraft turbomachine 100 to which the invention applies. This turbomachine 100 is here a bypass turbomachine extending along a longitudinal axis X. The bypass turbomachine generally comprises an external nacelle 101 surrounding a gas generator 102 upstream of which is mounted a fan 103. In the present invention, and in a general manner, the terms "upstream" and "downstream" are defined in relation to the flow of gases in the turbomachine 100. The terms "upper" and "lower" are defined with respect to a radial axis Z perpendicular to the axis X and with respect to the distance from the longitudinal axis X. A transverse axis Y is also perpendicular to the longitudinal axis X and the radial axis Z. These axes, X, Y, Z form an orthonormal mark.

In this example, the gas generator 102 comprises, from upstream to downstream, a low-pressure compressor 104, a high-pressure compressor 105, a combustion chamber 106, a high-pressure turbine 107 and a low-pressure turbine 108. The gas generator 102 is housed in an internal casing 109.

The fan 103 is shrouded here and is also housed in the nacelle 101. In particular, the turbomachine comprises a fan casing 56 which surrounds the fan. To this fan casing 56 is attached a retention casing 50 which surrounds the plurality of fan mobile vanes 51 which extend radially from the fan shaft mounted along the longitudinal axis X. The fan casing 56 and the retention casing 50 are integral with the nacelle 101 which surrounds them. The nacelle 101 is generally cylindrical in shape. The fan casing 56 is located downstream of the retention casing 50 ensuring the retention of the fan vanes 51.

The fan 103 compresses the air entering the turbomachine 100, which is divided into a hot flow circulating in an annular primary vein V1 which passes through the gas generator 102 and a cold flow circulating in an annular secondary vein V2 around the gas generator 102. In particular, the primary vein V1 and the secondary vein V2 are separated by an annular inter-vein casing 110 arranged between the nacelle 101 and the internal casing 109. During operation, the hot flow circulating in the primary vein V1 is conventionally compressed by compressor stages before entering the combustion chamber. The combustion energy is recovered by turbine stages that drive the compressor stages and the fan. The fan is rotated by a power shaft of the turbomachine via, in this example, a power transmission mechanism 57 to reduce the rotation speed of the fan. Such a power transmission mechanism is provided in part because of the large diameter of the fan. The large diameter of the fan makes it possible to increase the bypass ratio. The power transmission mechanism 57 comprises a reduction gear, here arranged axially between a fan shaft attached to the fan and the power shaft of the gas generator 102. The cold air flow F circulating in the secondary vein V2 is oriented along the longitudinal axis X and contributes to provide the thrust of the turbomachine 100.

Figure 4:
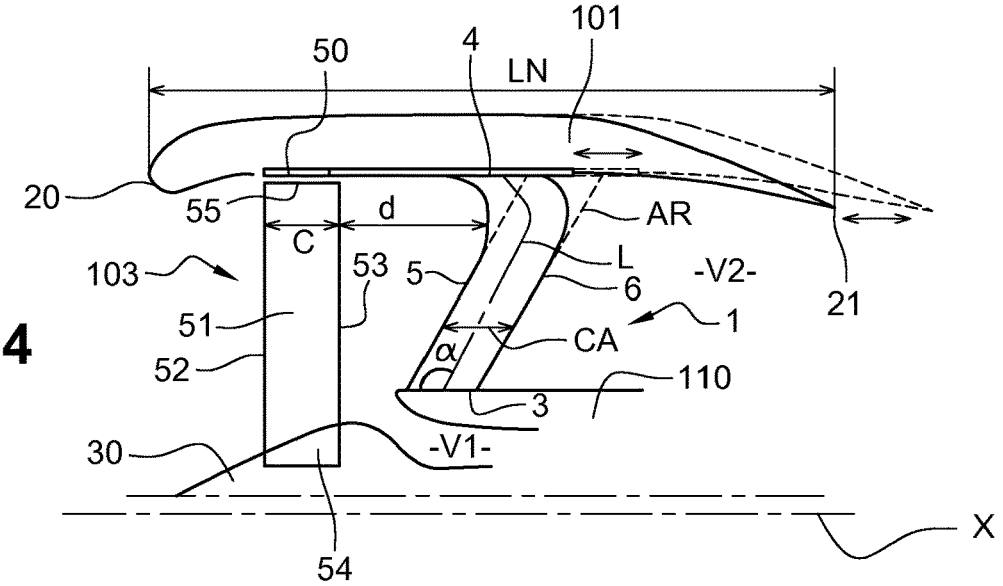
FIGS. 4 and 5 are schematic and partial views in axial sections of a nacelle housing a turbomachine fan according to the invention.

With reference to FIGS. 1 and 4, each fan vane 51 has a leading edge 52, upstream, and a trailing edge 53, downstream, axially opposite (along the longitudinal axis X). The fan vanes 51 each have a root 54 located in a hub 30 through which the fan shaft passes and a tip 55 opposite the retention casing 50. The fan vanes 51 have a diameter DF of, for example, 1700 to 2800 mm. The diameter DF is measured at the leading edge 52 and at the tip 55 of fan vane 51 along the radial axis Z. Preferably, but not restrictively, the diameter DF is between 1900 and 2700 mm. The nacelle 101 has an external diameter DN of, for example, 2000 to 4000 mm. Preferably, but not restrictively, the outside diameter DN is between 2400 and 3400 mm.

At least one stator vane 1 or radial stationary vane known as a fan flow-straightener vane or fan flow guide vane is arranged in the secondary vein V2. The flow-straightener vane is also known by the acronym OGV for "Outlet Guide Vane" and thus straightens the cold flow generated by the fan 103. In the present invention, the term "stationary vane" or "stator vane" means a vane that is not rotated about the axis X of the turbomachine 100. In other words, this flow-straightener vane is distinct from and contrary to a moving vane or rotor vane of the turbomachine 100. In the present example, a plurality of flow-straightener vanes 1 is arranged transversely in the fan nacelle 101 substantially in a plane transverse to the longitudinal axis X. The nacelle 101 then surrounds the flow-straightener vanes. To straighten the flow of the fan 103, between ten and fifty flow-straightener vanes 1 are distributed circumferentially to form a flow-straightener stage. These flow-straightener vanes 1 are arranged downstream of the fan 103. In this example, they are attached to the fan casing 56. They are evenly distributed around the axis X of the turbomachine.

Figure 2:
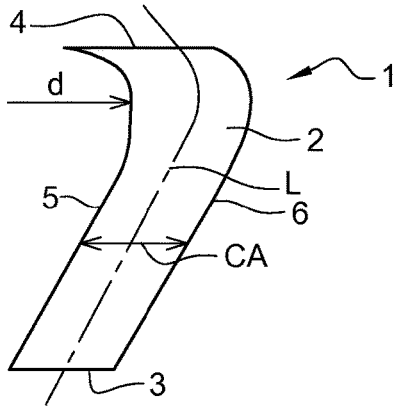
FIG. 2 schematically illustrates a turbomachine vane according to the invention when viewed from the front.
Figure 3:
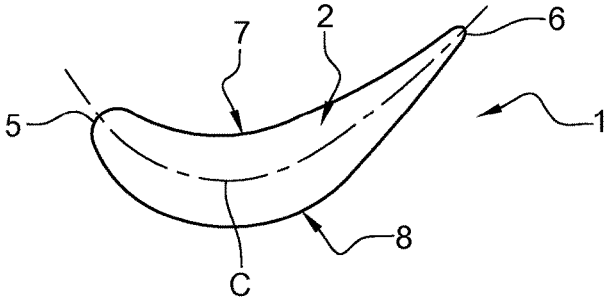
FIG. 3 schematically represents a cross section of a vane according to the invention.

With reference to FIGS. 2 and 3, each flow-straightener vane 1 comprises a plurality of transverse vane sections 2 stacked in a radial direction (parallel to the radial axis Z) along a stacking line L between a root end 3 and a tip end 4. The stacking line L passes through the centre of gravity of each transverse vane section 2. Each vane section comprises a pressure-face surface 7 and a suction-face surface 8 extending substantially in an axial direction between a leading edge 5, upstream and a trailing edge 6, downstream. The pressure-face and suction-face surfaces 7, 8 are opposite to each other in a tangential direction (parallel to the axis Y). Between the trailing edge 6 and the leading edge 5 extends a profile chord CA. The vane section 2 comprises a curved transverse profile. The profile chord CA has a substantially constant axial length between the root end 3 and the tip end 4. In other words, the length of the profile chord at the root end is substantially equal to the length of the profile chord at the tip end.

The stacking line L of the vane sections 2 forming the vane has a curvature in the vicinity of the tip end 4 of the vane. The flow-straightener vane 1 here is approximately boomerang-shaped. As shown in FIG. 2, the curvature is oriented from downstream to upstream (radially outwards). In particular, the leading edge 5 and the trailing edge 6 follow the curvature movement of the stacking line L. That is to say, the direction of the leading edge 5 and trailing edge 6 are substantially parallel to the direction of the curvature of the stacking line L in the upper part of the vane 1. As can be seen in FIG. 2, the curvature is continuous and progressive. That is, there is no abrupt change of direction. The curvature of the stacking line L is oriented in a perpendicular plane passing through the longitudinal axis X. The stacking line L is therefore defined in this plane. The curvature is also located towards the tip end 4. This is between 50% and 95% of the height H of the vane 1 taken between the root end 3 and the tip end 4 of the vane as described later in the description.

Each flow-straightener vane 1 is attached to the inner casing 110 and the fan casing 56 attached to the nacelle 101. The flow-straightener vanes 1 provide a structural function, providing load take-up. With reference to FIG. 4, the root end 3 is connected, in this example, to the inner casing 110, while the tip end 4 is connected to the fan casing 56. In the curved part of the vane 1, the leading edge 5 is concave while the trailing edge 6 is convex. Thus, we observe an axial deviation (or deformation) of the stacking line L. In particular, the vane 1 has a first portion with a substantially straight stacking line L. This so-called straight stacking line is located in the lower part of the vane 1. The latter has a downstream inclination, in a plane containing the longitudinal axis X, with respect to the axis X. The inclination forms an angle $\alpha$ of between 105° and 145° between the stacking line L and the axis X (the stacking line being oriented downstream).

Similarly, according to FIG. 4, a first portion of the trailing edge 6 extends along a straight line forming an angle $\beta 1$ with the longitudinal axis. This angle $\beta 1$ is between 90° and 120°, with the trailing edge 6 facing downstream. This angle $\beta 1$ varies from the longitudinal axis from upstream to downstream. The vane 1 also has a second portion where the stacking line L has the curvature or a bend. The trailing edge 6 also has a curvature or a bend on the second portion of the vane 1. In particular, the curvature of the trailing edge 6, in the upper part of the vane 1, is determined by an angle $\beta 1$ formed between a straight line tangent T to the trailing edge 6 and the longitudinal axis X. In this example, the angle $\beta 1$ varies in the upper part of the vane 1. The upper part of the trailing edge with the curvature is between 50% and 95% of the height H of the vane 1 from the root end of the vane. The angle β1 of curvature of the trailing edge 6 is between 75° and 90°, the trailing edge being directed upstream and the value of 90° not included. In other words, the angle β1 between the longitudinal axis and the trailing edge 6 is substantially constant between 0 and 50% of the vane height. The angle β1 then varies between 50% and 95% of the vane height 1. We therefore understand that there is no right angle and therefore no abrupt change of direction of the trailing edge. Such a configuration makes it possible, on the one hand, to reduce the space requirement and, on the other hand, to maintain a predetermined minimum axial distance d close to the initial predetermined minimum axial distance of a conventional flow-straightener vane. The minimum axial distance is measured between the trailing edge 53 of the fan vane 51 and the leading edge 5 of the flow-straightener vane. In addition, the curved shape avoids accentuating the vortex phenomena in the vicinity of the vane that are responsible for the noise.

Figure 6:
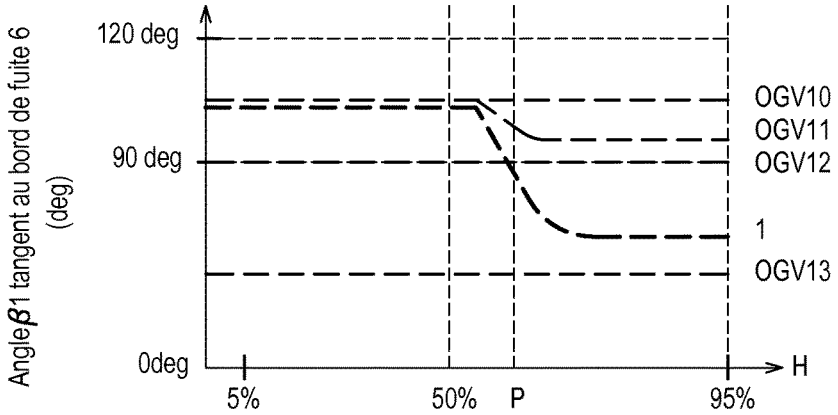
FIG. 6 is a schematic representation of a graph showing the variation of angles with respect to the longitudinal axis of the turbomachine measured at the trailing edge of the turbomachine vane.
Figure 8:
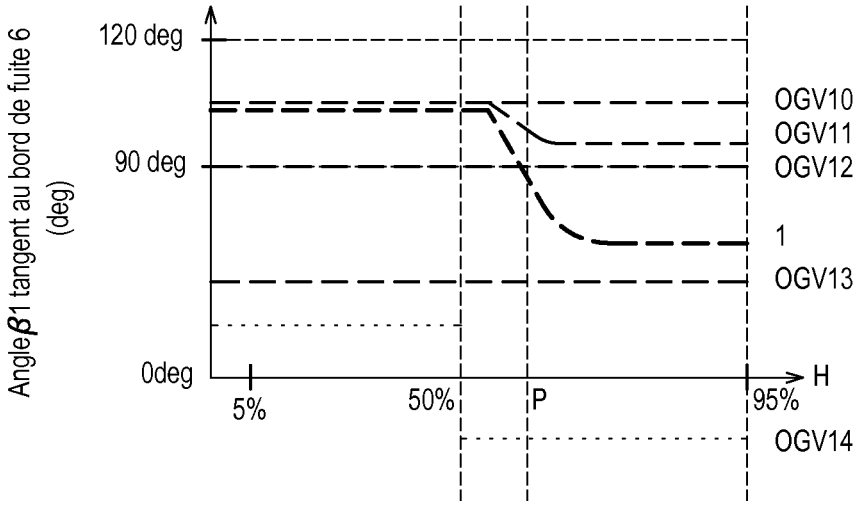
FIG. 8 is another schematic representation of a graph showing the angles measured at the trailing edge of turbomachine vanes and in particular of the prior art in relation to the flow-straightener vane according to the invention.

The angles β1 of the trailing edge 6 to the longitudinal axis are plotted in a graph of FIG. 6 and of FIG. 8 in comparison with flow-straightener vane trailing edge angles of the prior art. In this figure the trailing edge angles of the prior art vanes have an angle between 90° and 120° and is constant along the vane height (OGV10 and OGV12), or between 90° and 120° between 50% and 95% of the vane height (OGV11), or between 0° and 90° and is constant along the vane height (OGV13). The flow-straightener vane OGV14 shown in FIG. 8 corresponds to the vane of prior art document U.S. Pat. No. 6,554,564 which has a sweep angle in the median part of the vane height. The value of the angle is constant over the first 50% of the vane height from the root end and also constant but completely opposite over the last 50% of the vane height from the median part to the tip end of the vane. We can see that there is a break in the two straight lines due to the abrupt change of direction. Conversely, the flow-straightener vane of the present invention has an angle whose value is constant and between 90° and 120°, between 0 and 50% of the height of the vane, and whose value varies between 75° and 90° between 50% and 95% of the height of the vane. The line representing the variation of the angle of the vane 1 is continuous. In other words, there is no break in the continuity of the line representing the variation of the angle.

In particular, a distinction must be made between at least two ranges of angle variation at the trailing edge of the flow-straightener vane according to the invention. According to a mathematical representation with P a point belonging to the curve representing the height H of the flow-straightener vane 1 and in particular between 50% and 95% of the height H:

- the first domain of the vane 1 is: Height=[5%; P] where the value of β1 is greater than or equal to 90°, and
- the second domain of the vane 1 is: Height=[P; 95%] where the value of β1 is strictly less than 90°.

We can thus see in FIG. 4 that the tip end 4 of the flow-straightener vane 1 is connected to the fan casing 56 in a fastening area further upstream of the fastening area of a flow-straightener vane AR of the prior art shown in dotted line. In other words, the tip end 4 of the vane of the present invention is offset upstream due to the curvature. This offset and/or the curvature makes it possible to shorten the length, substantially along the longitudinal axis X, of the nacelle 101. The nacelle here has a length LN of between 3000 and 3800 mm taken between an upstream end 20 forming an air inlet lip and a downstream end 21 forming a nozzle edge. Preferably, but not restrictively, the length LN is between 3100 and 3500 mm. The gain in reducing the length of the nacelle is between, for example, 5 and 15% compared with a standard turbomachine nacelle without the invention as this is shown in dotted line in FIG. 4.

More precisely, the arrangement of the vane 1 according to the invention allows the reduction of the length of the nacelle 101 without aggravating the acoustic nuisance for the same given fan diameter. The gain in length makes it possible to reduce the aerodynamic drag of the turbomachine and/or the integration of larger surfaces of acoustic panels for equivalent drag as described later in the invention. The acoustic gain is approximately 2 EPNdB (Effective Perceived Noise or Effective Perceived Noise in decibels).

For the same given fan diameter, and at acoustic iso margin, the ratio of the length of the nacelle to the diameter of the fan (LN/DF) can be between −5% and −15% compared to a turbomachine without the invention, which implies a reduction in the length of the nacelle of between −5% and −15% compared to the turbomachine without the invention. In particular, the LN/DF ratio is for example between 1 and 3. Preferably, but not restrictively, the ratio is between 2.1 and 2.8.

The relative minimum axial distance between the fan vanes and the flow-straightener vanes is determined by the relationship d/C. d is the predetermined minimum axial distance between the trailing edge 53 of the fan and the leading edge 5 of the flow-straightener vane 1, and C is the length of the axial chord of the fan. The fan chord length C is measured between the leading edge 52 and the trailing edge 53 of the fan vane.

The solution can also result in the following condition to be observed:

$$\left(\frac{d}{c}\right)_{50\%\,H<H<95\%\,H} > \left(\frac{d}{c}\right)_{100\%\,H}.$$

H corresponds to the outer radius of the flow-straightener vane 1 taken between the root end and the tip end of the vane 1. In other words, between 50% and 95% of the vane height H, the relative minimum axial distance between the fan 103 and the flow-straightener vane 1 is greater than the relative minimum axial distance measured at the tip end of the vane, i.e. for 100% of the height H of the flow-straightener vane 1.

According to a further characteristic of the invention, the following two conditions can be implemented:

$$\left(\frac{d}{c}\right)_{80\%\,H} > \alpha\left(\frac{a}{c}\right)_{100\%\,H}.$$

$$\text{With } \left(\frac{d}{c}\right)_{100\%\,H} < \Omega.$$

The parameter α corresponds to an efficiency factor. The parameter α considered to be greater than 1.1 is defined as a condition for guaranteeing the effectiveness of the invention. The parameter Ω is a parameter characterizing the condition Ω<3 to constrain the length of the nacelle and to maintain the desired performance advantage. In particular, we consider d the distance between the fan vane and the flow-straightener vane as a function of the height H (d(H)), the percentage height of vane 1 with 0% H (at the root end of the vane 1) and 100% H (at the tip end of the vane 1). For each distance d considered between 50% and 95% of the vane height, the vane height is greater than the distance d at the tip end of the vane 1 (100% H): d(r [50%–95%])>d (100%). This allows the flow-straightener vane to be brought closer to the fan vane at the root and tip end of the vane 1 without impacting the distance from the vane 1 on the portion of the vane height between 50% and 95% where the aeroacoustics phenomena are most intense. In other words, the distance of propagation of the wake of the fan as well as its dissipation are maximized and optimized.

Since the length of the nacelle after the vanes (between the tip end of the vane 1 and the downstream end 21 of the nacelle) is not shortened, an acoustic treatment of the nacelle can be considered. Such acoustic treatment may include the arrangement of acoustic panels to further reduce noise. Such acoustic panels are advantageously, but not restrictively, placed on an inner face of the nacelle 101 downstream of the flow-straightener vanes 1.

Figure 5:
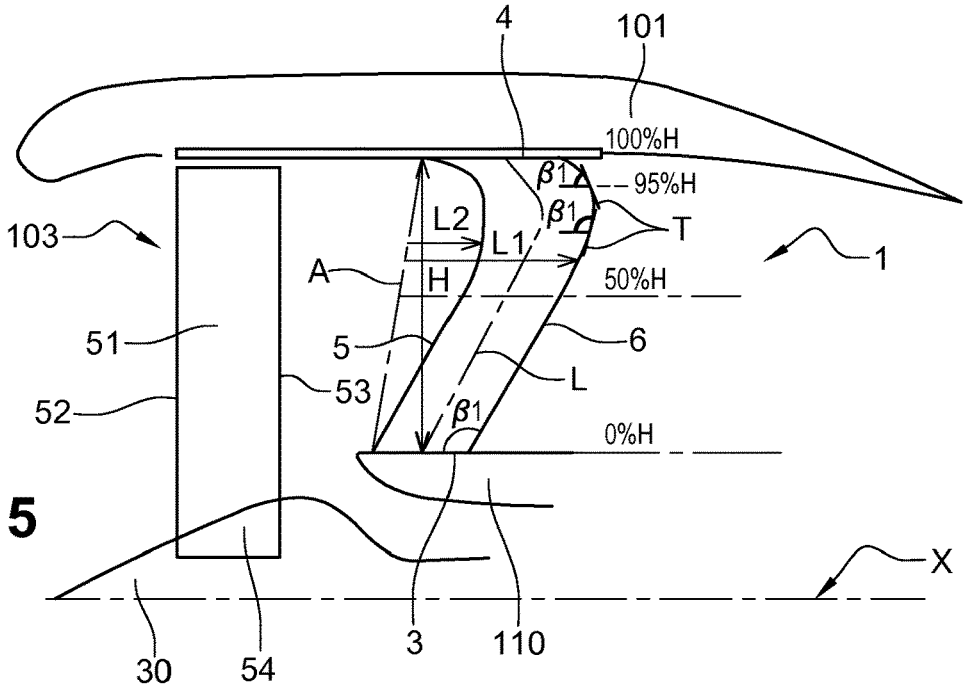

Following an embodiment illustrated in FIG. 5, the shape of the vane 1 is characterized by the following relationship:

$$0,1 < \left(\frac{L2}{L1}\right)_{50\%\ H<H<95\%\ H} < 0,5.$$

L2 corresponds to the minimum distance between the leading edge 5 of the flow-straightener vane 1 and the line A passing through the root end and the tip end of the vane taken at the leading edge 5. L1 corresponds to the length between this same line A and the trailing edge 6 of the flow-straightener vane. The lower (0.1) and upper (0.5) boundaries are determined in such a way as to limit the maximum angle of inclination of the stacking line L at the root end 3 of the flow-straightener vane 1 while limiting the curvature of the stacking line. The result is a curvilinear shape that limits structural stresses (flexibility of the flow-straightener vane). This is a particular advantage for a flow-straightener vane that is not very structural (which does not contribute to the suspension of the engine).

Figure 7:
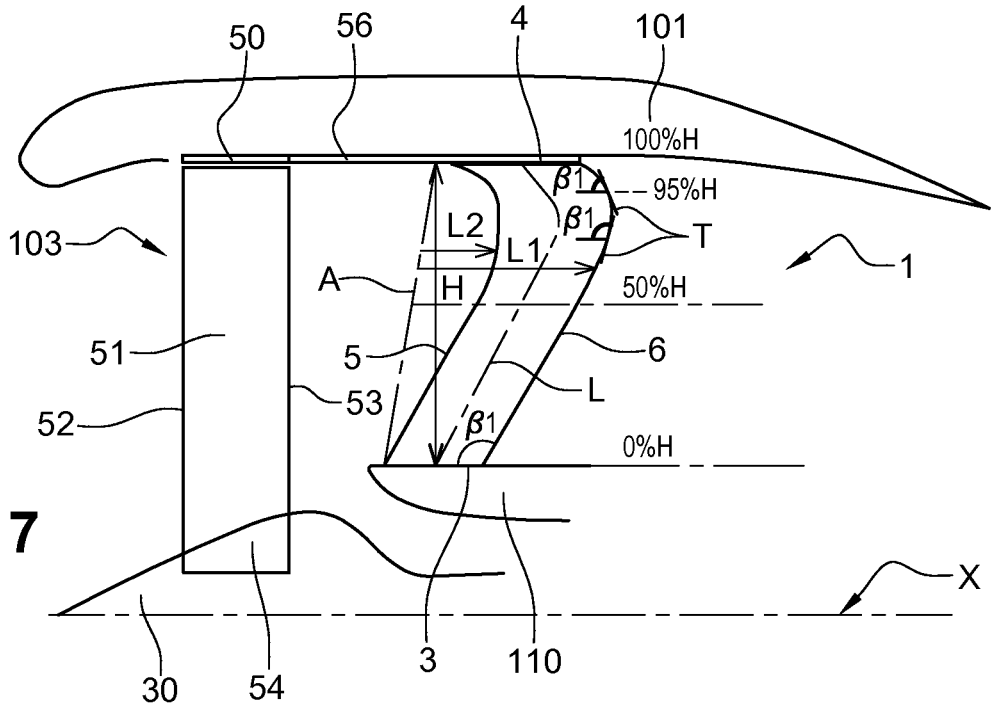
FIG. 7 schematically illustrates, in an axial and partial section, another embodiment of the invention in which a nacelle envelops a fan and at least one flow-straightener vane, the flow-straightener vane comprising a downstream end at the tip end which is immediately downstream of a downstream end of the fan casing.

Following yet another embodiment illustrated in FIG. 7, the vane 1 has the same characteristics as those shown in FIGS. 4 and 5. The elements described above are referred to in the following description by the same numerical references. The nacelle encloses the vane 1 and the fan. As can be seen, the downstream end of the tip end of the vane 1 is located downstream of the downstream end of the fan casing to reduce the mass of the turbomachine. The nacelle is made of lighter materials than the fan casing. We are thus seeking to limit the extension of the fan casing to replace it with the nacelle. Nacelle equipment such as a thrust reverser can be integrated further upstream, and in particular closer to the fan, which reduces the axial extension of the nacelle and the turbomachine. The downstream end of the tip end 4 is located opposite the nacelle 101.

The invention claimed is:

1. A flow-straightener vane of a bypass turbomachine with a longitudinal axis (X), the vane comprising a plurality of vane sections stacked radially with respect to the axis (X) along a stacking line (L) between a root end and a tip end, each vane section comprising a pressure-face surface and a suction-face surface extending axially between an upstream leading edge and a downstream trailing edge and being tangentially opposed, wherein between the leading and trailing edges of each vane section there is formed a profile chord (CA) the length of which is constant between the tip end and the root end, and in that the stacking line (L) has a curvature, in a plane passing through the axis (X) and through the stacking line (L), located in the vicinity of the tip end and oriented from downstream to upstream, wherein the shape of the vane between 50% and 95% of a height of the vane is determined by the following relationship: $0.1<(L2/L1)_{50\%\ H<H<95\%\ H}<0.5$, with L2 corresponding to a minimum distance between the leading edge of the vane and a straight line (A) passing through the root end and the tip end of the vane, L1 corresponding to a length between this same line (A) and the trailing edge of the vane, and H being the height of the vane.

2. The vane according to claim 1, wherein the curvature of the stacking line (L) is continuous and progressive.

3. The vane according to claim 1, wherein the curvature is located between 50% and 95% of a height of the vane between the root end and the tip end.

4. The vane according to claim 1, wherein the vane has a first root portion whose stacking line (L) extends along a straight line and a second tip portion whose stacking line (L) comprises the curvature.

5. The vane according to claim 1, wherein the leading edge has a concave portion and the trailing edge has a convex portion at the curvature.

6. A bypass turbomachine, comprising at least one flow-straightener vane according to claim 1.

7. The vane according to claim 1, wherein direction of the leading edge and the trailing edge are curved and substantially parallel to the curvature of the stacking line.

8. The vane according to claim 1, wherein the trailing edge has a second portion with a curvature determined by an angle β1 formed between a straight line tangent to the trailing edge and the longitudinal axis X, said angle β1 varying in an upper part of the vane and between 75% and 90% of the height H of the vane from the root end of the vane.

9. An assembly comprising a nacelle of a bypass turbomachine extending along a longitudinal axis (X) and a fan casing secured to the nacelle, the fan casing surrounding a fan and defining downstream of the fan an annular vein in which an air flows circulates, the fan comprising fan vanes, characterised in that the fan casing comprises an annular row of flow-straightener vanes according to claim 1, each flow-straightener vane being arranged transversely to the longitudinal axis (X) in the annular vein, downstream of said fan vanes, wherein the relative axial distance between a fan vane and a flow-straightener vane is determined by the following condition:

(d/C), where d is the predetermined minimum axial distance between a trailing edge of the fan and the leading edge of the flow-straightener vane, and C is the length of the axial chord of the fan vane, and in that the curvature of the stacking line (L) is determined by the following relationship: $(d/C)_{50\%\ H<H<95\%\ H}>(d/C)_{100\%\ H}$, where H is the height of the flow-straightener vane between the tip end and the root end.

10. The assembly according to claim 9, wherein the nacelle has a length (LN) along the longitudinal axis (X) and the fan has a diameter (DF) along the radial axis, the ratio (LN/DF) of the length of the nacelle to the diameter of the fan being between 1 and 3.

11. A bypass turbomachine, comprising at least one flow-straightener vane according to an assembly according to claim 9.

* * * * *